US009381408B2

(12) United States Patent
Kuhar et al.

(10) Patent No.: US 9,381,408 B2
(45) **Date of Patent: *Jul. 5, 2016**

(54) IRON-TYPE GOLF CLUB HEAD

(71) Applicant: CALLAWAY GOLF COMPANY, Carlsbad, CA (US)

(72) Inventors: Justin Kuhar, San Diego, CA (US); Joseph Mehren, San Diego, CA (US); Irina Ivanova, San Diego, CA (US); Bradley C. Rice, Carlsbad, CA (US); Scott R. Manwaring, Carlsbad, CA (US); Brandon D. DeMille, Carlsbad, CA (US); Patrick Dawson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 66 days.

This patent is subject to a terminal disclaimer.

(21) Appl. No.: 14/579,724

(22) Filed: Dec. 22, 2014

(65) Prior Publication Data

US 2015/0111663 A1 Apr. 23, 2015

Related U.S. Application Data

(63) Continuation of application No. 13/906,551, filed on May 31, 2013, now Pat. No. 8,915,797, which is a continuation-in-part of application No. 13/762,591, filed on Feb. 8, 2013, now Pat. No. 8,911,302.

(60) Provisional application No. 61/719,811, filed on Oct. 29, 2012.

(51) Int. Cl.
*A63B 53/04* (2015.01)
*A63B 53/06* (2015.01)

(52) U.S. Cl.
CPC ..... *A63B 53/047* (2013.01); *A63B 53/0475* (2013.01); *A63B 53/06* (2013.01); *A63B 2053/0416* (2013.01); *A63B 2053/0433* (2013.01); *A63B 2053/0491* (2013.01)

(58) Field of Classification Search
CPC ..... A63B 53/047; A63B 53/06; A63B 2053/0416; A63B 2053/0433; A63B 53/0475; A63B 2053/0491
USPC ..... 473/324–350, 287–292
See application file for complete search history.

(56) References Cited

U.S. PATENT DOCUMENTS 8,911,302 B1 * 12/2014 Ivanova ..... A63B 53/0475 473/329
8,915,797 B1 * 12/2014 Kuhar et al. ..... A63B 53/047 473/324

* cited by examiner

*Primary Examiner* — Sebastiano Passaniti
(74) *Attorney, Agent, or Firm* — Rebecca Hanovice; Michael Catania; Sonia Lari

(57) ABSTRACT

The present invention discloses an iron-type golf club head having a body and at least one weight disc having a first diameter, the body having a sole with a first recess, which comprises a first bore having a second diameter, a second bore having a third diameter, and a shelf located between the first bore and the second bore, the first diameter is smaller than the second diameter and greater than the third diameter, the first bore is sized to receive the at least one weight disc, the at least one weight disc rests against the shelf, and the at least one weight disc is secured within the first bore. The sole may further comprise second, third, and fourth recesses, each of which may have a first bore, a second bore, and a shelf.

14 Claims, 10 Drawing Sheets

IRON-TYPE GOLF CLUB HEAD

CROSS REFERENCES TO RELATED APPLICATIONS

The present application is a continuation application of U.S. patent application Ser. No. 13/906,551, filed on May 31, 2013, which is a continuation-in-part of U.S. patent application Ser. No. 13/762,591, filed on Feb. 8, 2013, now U.S. Pat. No. 8,911,302, issued on Dec. 16, 2014, which claims priority to U.S. Provisional Patent Application No. 61/719,811, filed on Oct. 29, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to an iron-type golf club head. More specifically, the present invention relates to an iron-type golf club head having a plurality of cavities, weights, and caps of different shapes, sizes, and compositions to improve forgiveness and refine the club head mass properties.

2. Description of the Related Art

The prior art discloses various types of weighting and cavities for golf club heads, especially iron-type golf club heads. In particular, tungsten alloy, with a density of around 17 g/cc, has been inserted into cavities in the sole to weight golf club heads for many years. Although the prior art provided useful methods for weighting iron type golf club heads, it has not optimized weighting in a way that achieves an ideal combination of forgiveness and golf club head mass properties.

BRIEF SUMMARY OF THE INVENTION

The present invention provides a golf club that is forgiving and allows for optimization of feel, sound, backspin, launch angle, compliance, and ball speed, as well as club head mass properties such as center of gravity and moment of inertia.

One aspect of the present invention is an iron-type golf club head comprising a body comprising a top portion, a sole portion, and a front opening, and a face plate, wherein the face plate covers the front opening, wherein the sole portion comprises at least one sole pocket, and wherein the at least one sole pocket is bounded on at least one side by the face plate. The face plate may be only partially affixed to the body, and in one embodiment may be welded to at least one corner of the sole pocket. In some embodiments, the club may further comprise a cap sized to cover the sole pocket. In some further embodiments, the cap may not be affixed to and may not make contact with the face plate. In other embodiments, the cap may fit within the sole pocket and comprise at least one cavity. In still other embodiments, the cap may fit within and fill the sole pocket. In some embodiments, the cap may be composed of multiple materials having different densities. In still other embodiments, the body may be forged, and the face plate may have variable thickness.

Another aspect of the present invention is an iron-type golf club head comprising a body comprising a top portion, a sole portion, a face portion, a rear cavity, and a sole pocket, and a cap sized to fit within the sole pocket, wherein the cap comprises at least one cavity, and wherein when the cap is disposed within the pocket, the cavity faces towards the top portion, and the pocket comprises an empty space. In some embodiments, the body may further comprise at least one secondary pocket. In other embodiments, the cap may comprise two cavities.

Yet another aspect of the present invention is an iron-type golf club head comprising a body comprising a top portion, a sole portion, a face portion, a rear cavity, and a sole pocket, and a cap sized to fit within the sole pocket, wherein the cap is composed of at least two materials having different densities, and wherein the cap completely fills the sole pocket. The body may further comprise at least one secondary pocket, and in some embodiments may be integrally cast.

Another aspect of the present invention is an iron-type golf club head comprising a body comprising a top portion, a sole portion, a face portion, a rear cavity, and a sole pocket, and a cap, wherein the sole pocket has a first width and at least two opposing walls, wherein the cap has a second width that is smaller than the first width, wherein when the cap is disposed within the sole pocket, at least a first gap and a second gap are formed between the walls of the sole pocket and the cap, wherein the first gap has a third width, wherein the second gap has a fourth width, and wherein the third width is not equivalent to the fourth width. In some further embodiments, the gaps may be filled with a low-density dampening material, while in other embodiments, the gaps may be empty. In one embodiment, the cap may comprise at least one cavity.

Yet another aspect of the present invention is an iron-type golf club head comprising a body comprising a top portion, a sole portion, and a face component, and at least one weight disc having a first diameter, wherein the sole comprises a first recess, wherein the first recess comprises a first bore having a second diameter, a second bore having a third diameter, and a shelf located between the first bore and the second bore, wherein the first diameter is smaller than the second diameter and greater than the third diameter, wherein the first bore is sized to receive the at least one weight disc, wherein the at least one weight disc rests against the shelf, and wherein the at least one weight disc is secured within the first bore. The face component may be selected from the group consisting of a face plate and a face insert. In some embodiments, the at least one weight disc may be covered with welding material.

In some further embodiments, the sole may comprise second recess, a third recess, and a fourth recess, and each of the second, third, and fourth recesses may comprise a first bore, a second bore, and a shelf. In yet a further embodiment, the golf club head may comprise a toe side, a heel side, and a center line, and at least three of the first, second, third, and fourth recesses may be disposed between the center line and the heel side. In some embodiments, the first recess may have a first depth, the second recess may have a second depth, the third recess may have a third depth, and the fourth recess may have a fourth depth, and each of the first, second, third, and fourth depths may differ from each of the other depths. In other embodiments, the first and second recesses may each have a first depth, the second and third recesses may each have a second depth, and the first depth may be less than the second depth. In still other embodiments, each of the first and second recesses may have a first maximum width, each of the second and third recesses may have a second maximum width, and the first maximum width may be greater than the second maximum width.

In some embodiments, the at least one weight disc may comprise a plurality of weight discs, each of which is sized to fit within the first bore of the first, second, third, and fourth recesses. In further embodiments, each of the plurality of weight discs may be composed of a material having a density of no less than 14 g/cc and no more than 18 g/cc. In still other embodiments, each of the plurality of weight discs may have a mass of no less than 0.50 g and no more than 1.0 g. In some embodiments, the second bore may be empty. In other embodiments, the body may be composed of a material having a density of no less than 5 g/cc and no greater than 9 g/cc. In some embodiments, the body may be integrally formed using a method selected from the group consisting of casting, forming, and forging. In one embodiment, the at least one weight disc may be composed of a tungsten alloy. In some embodiments, the at least one weight disc may be removably secured within the first bore. In one further embodiment, the iron-type golf club head may further comprise a cap, which may be affixed within the first bore and press the weight disc against the shelf.

Another aspect of the present invention is an iron-type golf club head comprising a forged metal body comprising a top portion, a sole portion, and a face component, and a plurality of tungsten alloy weight discs, wherein the sole portion comprises a plurality of recesses, wherein each of the plurality of recesses comprises a first bore having a first diameter, a second bore having a second diameter, and a shelf located between the first bore and the second bore, wherein the first diameter is greater than the second diameter, wherein the first bore is sized to receive one of the plurality of weight discs, wherein the weight disc rests against the shelf, and wherein welding material is disposed over the weight disc to permanently secure the weight disc within the first bore. In a further embodiment, the iron-type golf club head of claim may comprise a medallion, the body may comprise a rear cavity, and the medallion may be permanently affixed within the rear cavity. In other embodiments, the plurality of tungsten alloy weight discs may be composed of four tungsten alloy weight discs, and the plurality of recesses may be composed of four recesses.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
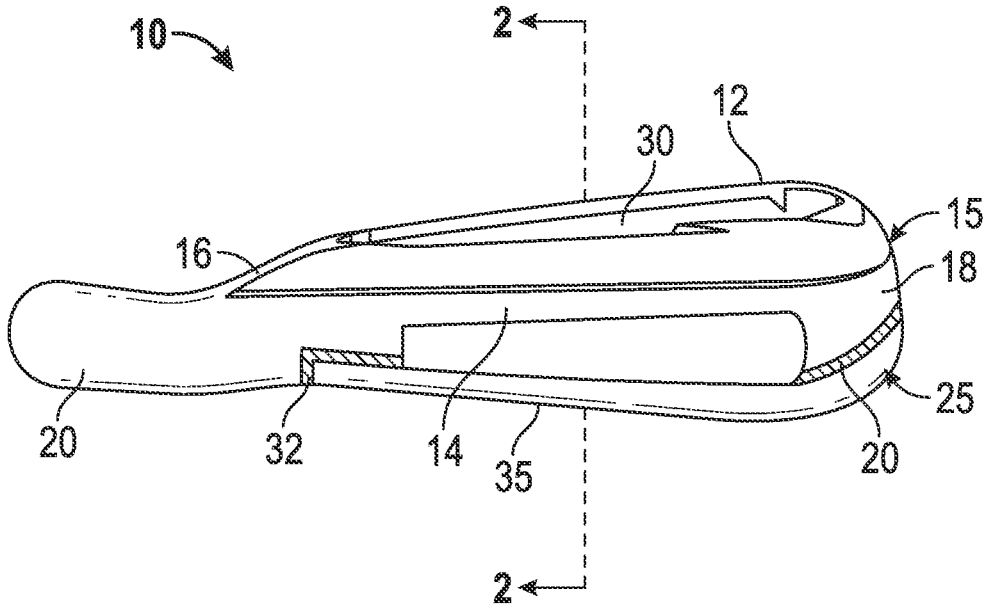
FIG. 1 is a sole perspective view of a first embodiment of the present invention.
Figure 2:
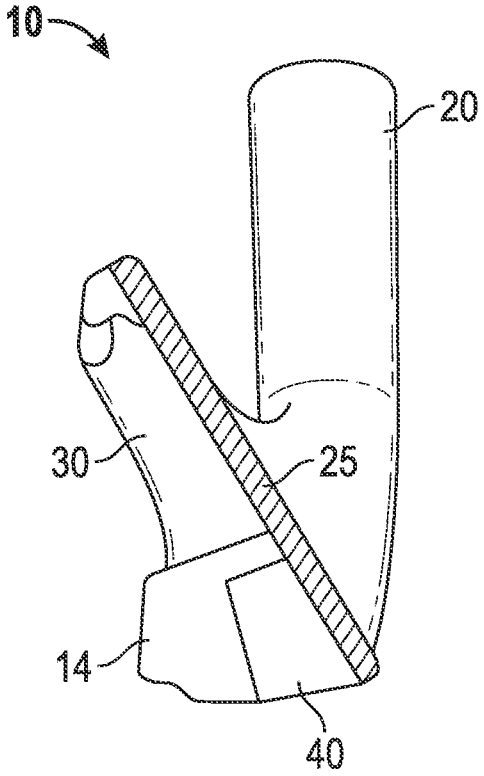
FIG. 2 is a cross-sectional view of the embodiment shown in FIG. 1 along lines 2-2.
Figure 3:
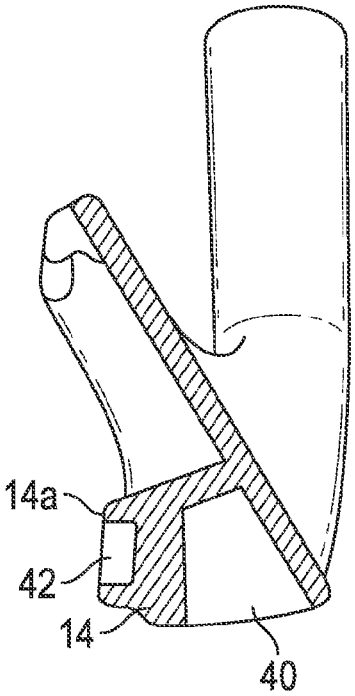
FIG. 3 is a cross-sectional view of a second embodiment of the present invention.
Figure 4:
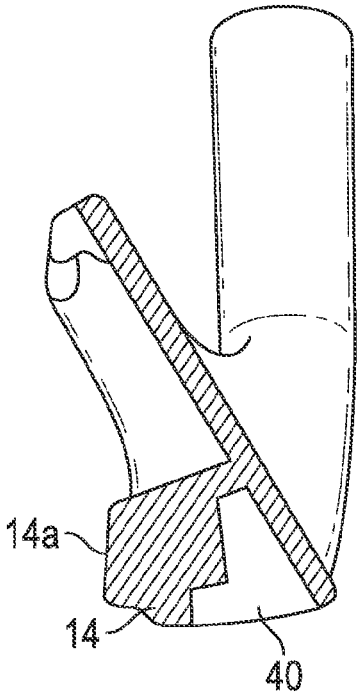
FIG. 4 is a cross-sectional view of a third embodiment of the present invention.
Figure 5:
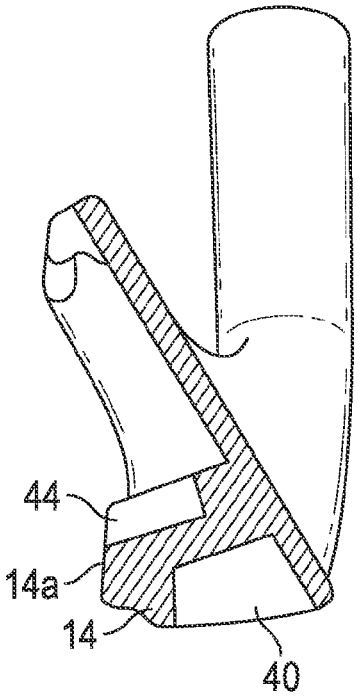
FIG. 5 is a cross-sectional view of a fourth embodiment of the present invention.

A first embodiment of the iron-type golf club head 10 of the present invention is shown in FIGS. 1-2. The golf club head 10 has a body 15 comprising a top portion 12 (also called a top rail), a sole portion 14, a heel portion 16, a toe portion 18, a rear cavity 30 encircled by the top portion 12, sole portion 14, and heel and toe portions 16, 18, a front opening 35, and a hosel 20, and also comprises a separate face plate 25 disposed proximate the front opening 35. The sole includes a sole pocket 40 proximate the front opening 35 and extending at least part of the way across the sole portion 14, as shown in FIG. 1, and upwards towards the rear cavity 30 as shown in FIG. 2. The pocket 40 is bounded partially by the body 15 and partially by the face plate 25, which is only partially (non 360°) attached by welding or brazing to the body 15 to close the front opening 35.

In the embodiment shown in FIG. 1, the weld line 32 formed between the face plate 25 and the body 15 does not extend to the forwardmost edge of the pocket 40, even if the pocket 40 is filled with or includes a weldable material. In the preferred embodiment, the pocket 40 is covered with any of the caps 50 disclosed herein, but in alternative embodiments it may be left uncovered or filled with a dampening material of various durometer values for fine-tuning the performance and/or sound and feel of the golf club head 10. In the preferred embodiment, the body 15 is cast and the face plate 25 comprises variable thickness, though in alternative embodiments the body 15 may be forged and/or machined, or the face plate 25 may have constant thickness.

Figure 6:
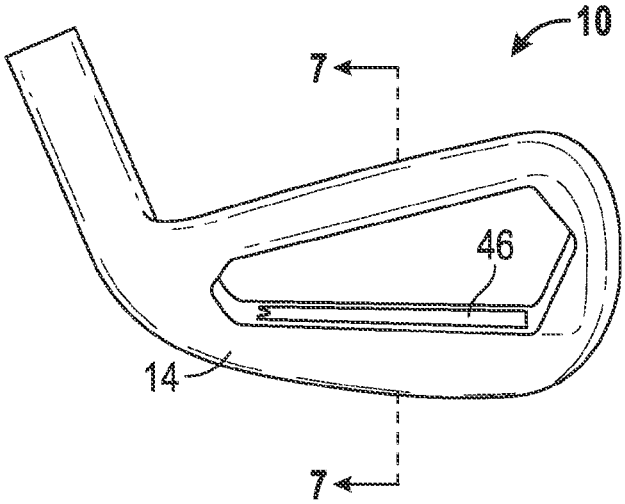
FIG. 6 is a rear perspective view of a fifth embodiment of the present invention.
Figure 7:
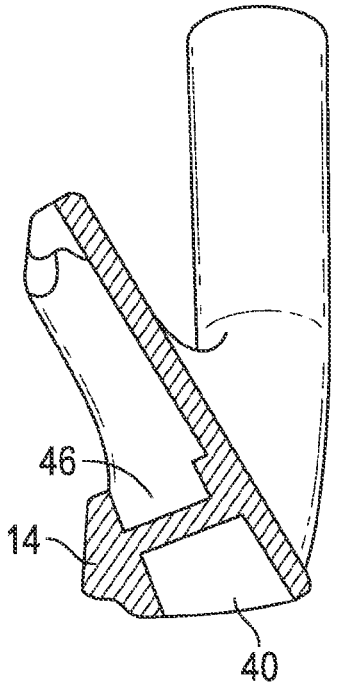
FIG. 7 is a cross-sectional view of the embodiment shown in FIG. 6 along lines 7-7.
Figure 8:
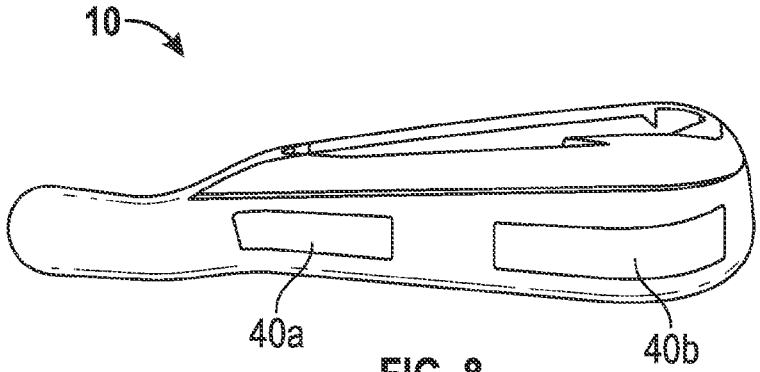
FIG. 8 is a sole perspective view of a sixth embodiment of the present invention.
Figure 9:
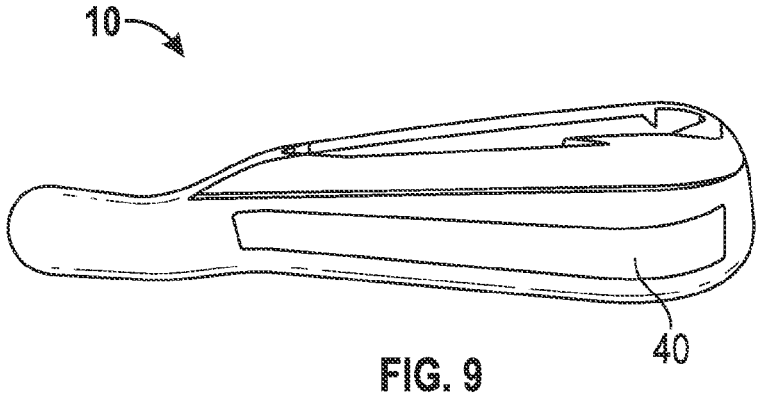
FIG. 9 is a sole perspective view of a seventh embodiment of the present invention.
Figure 23:
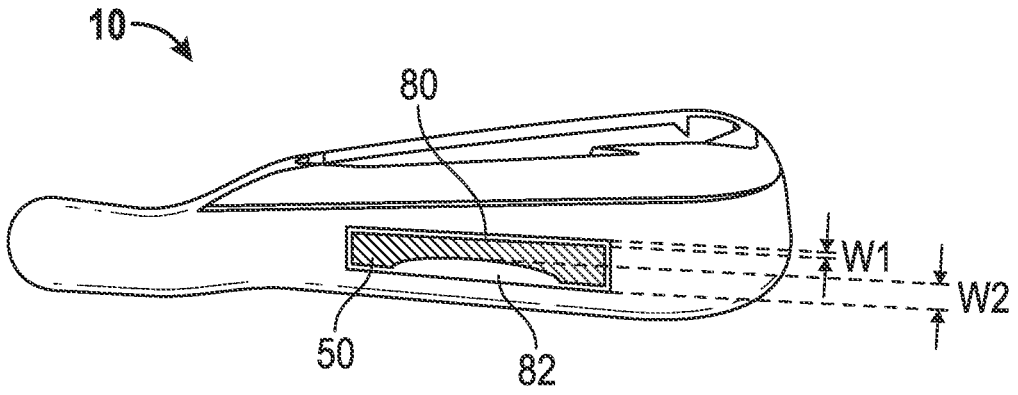
FIG. 23 is a sole perspective view of a seventeenth embodiment of the present invention.
Figure 24:
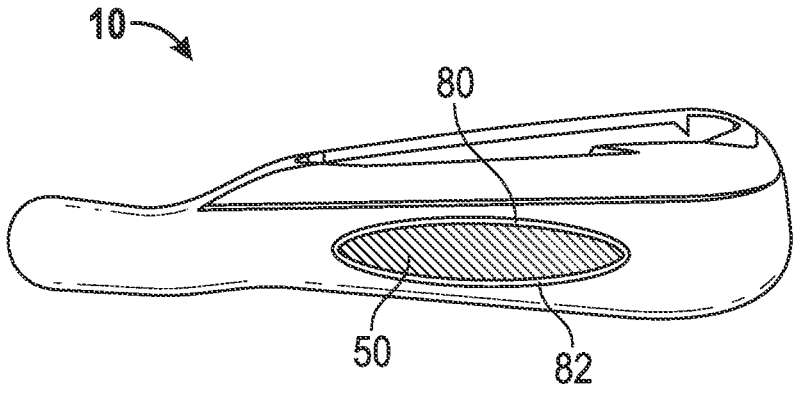
FIG. 24 is a sole perspective view of an eighteenth embodiment of the present invention.
Figure 25:
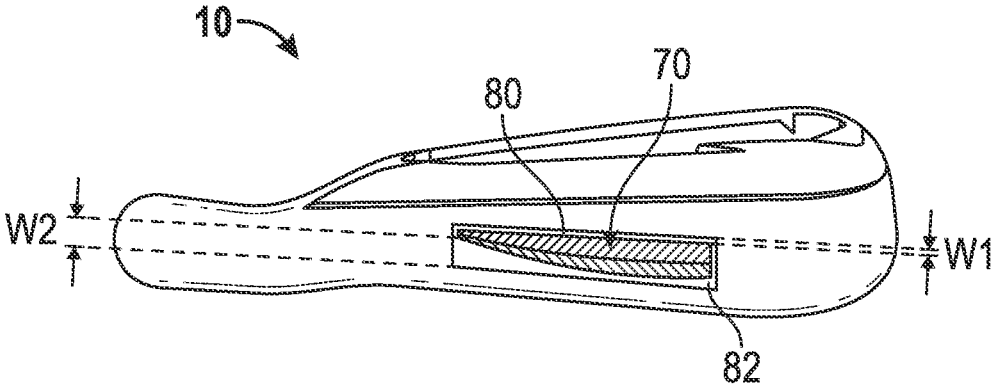
FIG. 25 is a sole perspective view of a nineteenth embodiment of the present invention.

In other embodiments, the pocket 40 may vary in size and in shape, as viewed from the sole portion and also via cross-section, and may have any of the cross-sectional shapes configurations shown in FIGS. 3-6 and outline shapes shown in FIGS. 23-25. In these other embodiments, the pocket 40 may not be bounded on one side by the face plate 25, which may instead be formed integrally with the golf club head 10. The club head 10 may also include secondary pockets 42, 44, 46 located at other positions in the sole portion 14, including extending into a rear surface 14*a* of the sole portion 14 or located within the rear cavity 30, as shown in FIGS. 6 and 7. The sole portion 14 may also comprise more than one pocket 40*a*, 40*b*, as shown in FIG. 8, which may have any size or shape and may be located anywhere in the lowermost surface of the sole portion 14. In another embodiment, the pocket 40 may extend along the entire length of the sole portion 14 from the heel portion 16 to the toe portion 18 as shown in FIG. 9. In each of these embodiments, the pockets 40, 42, 44, 46 may be covered with any of the caps 50 disclosed herein, filled with one or more dampening materials of various durometer values, or left uncovered.

Figure 10:
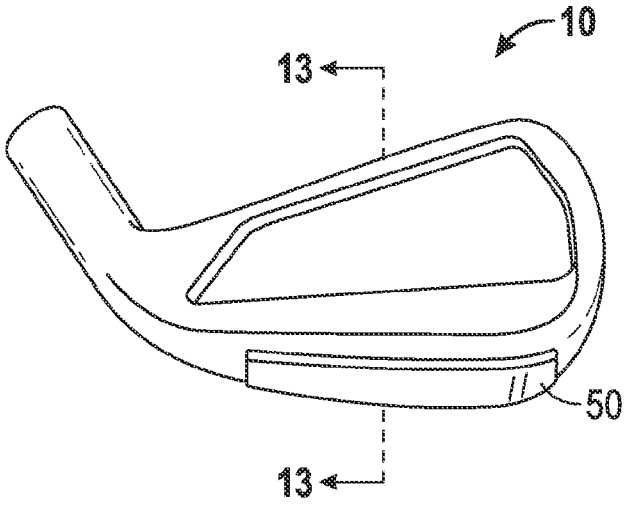
FIG. 10 is a rear perspective view of an eighth embodiment of the present invention.
Figure 11:
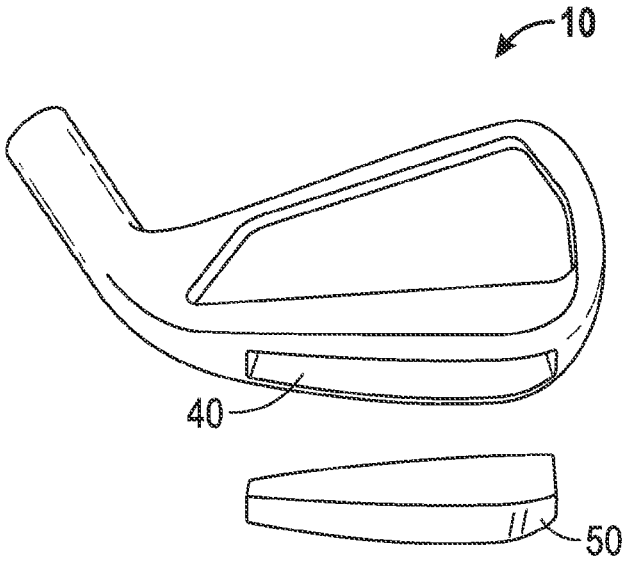
FIG. 11 is an exploded view of the embodiment shown in FIG. 10.
Figure 12:
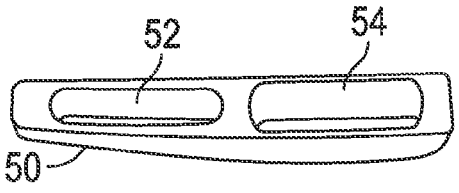
FIG. 12 is a top perspective view of the cap shown in FIGS. 10 and 11.
Figure 13:
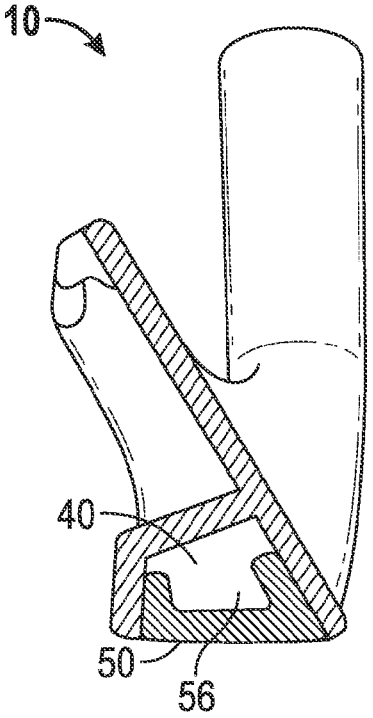
FIG. 13 is a cross-sectional view of the embodiment shown in FIG. 10 along lines 13-13.
Figure 14:
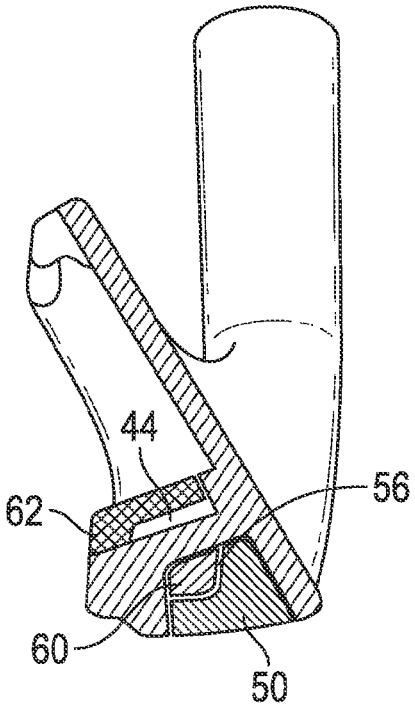
FIG. 14 is a cross-sectional view of a ninth embodiment of the present invention.
Figure 15:
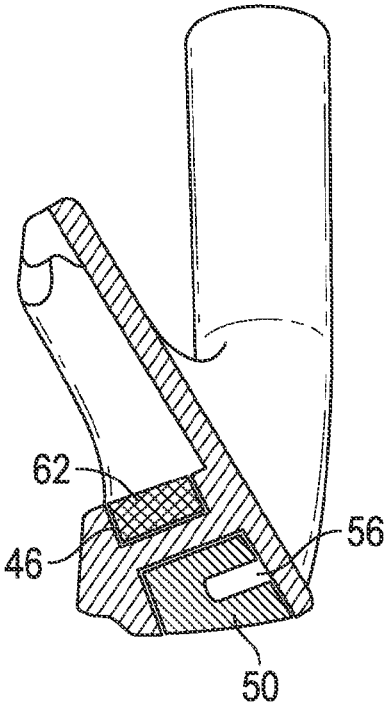
FIG. 15 is a cross-sectional view of a tenth embodiment of the present invention.
Figure 16:
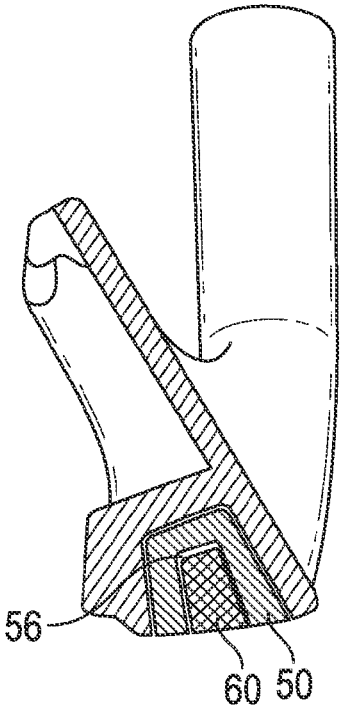
FIG. 16 is a cross-sectional view of an eleventh embodiment of the present invention.

Another embodiment of the golf club head 10 of the present invention, shown in FIGS. 10 and 11, includes a cap 50 disposed within the pocket 40 via bonding, welding, soldering, brazing, or mechanical fastening. Though the cap 50 may fill the entire pocket, as shown in FIG. 12, the cap 50 can include multiple cavities 52, 54, or a single cavity 56 as shown in FIG. 13. The function of these cavities 52, 54, 56 is to create an enclosed space within the pocket 40 to hold dampening or weight materials, or to adjust the sound and feel of the golf club head 10. The orientation of the cavities 52, 54, 56 of the cap 50 within the pocket 40 of the golf club head 10 is also variable, as shown in FIGS. 14-16. These Figures also show the inclusion of a secondary insert 60 in the cavities 52, 54, 56, which may be a single dampening or weight material having a density of 1.47 to 17 g/cc, or a combination of said materials. In the case of FIGS. 14 and 15, a tertiary insert 62 may be included in the secondary pockets 44, 46.

Figure 17:
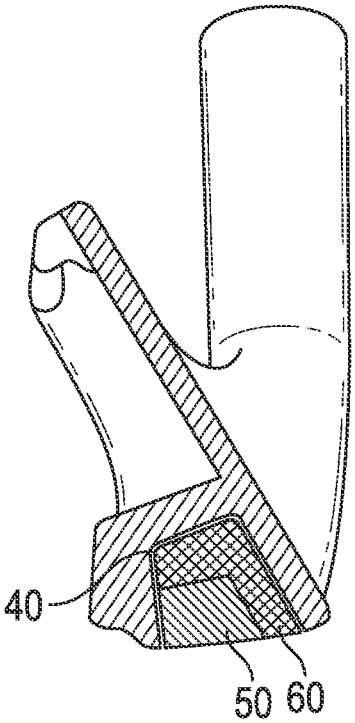
FIG. 17 is a cross-sectional view of a twelfth embodiment of the present invention.
Figure 18:
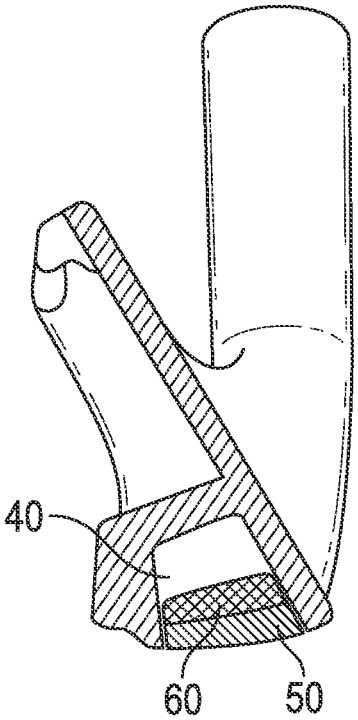
FIG. 18 is a cross-sectional view of a thirteenth embodiment of the present invention.
Figure 19:
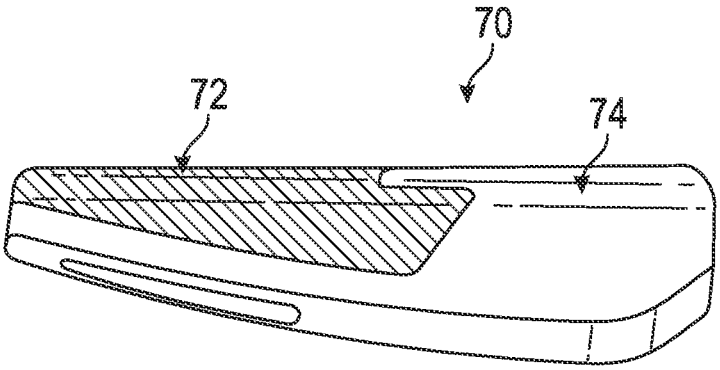
FIG. 19 is a side perspective view of an exemplary, multi-material insert for use with any of the embodiments of the present invention.

In other embodiments, shown in FIGS. 17-19 the cap 50 does not include one or more cavities 52, 54, 56 but is instead inserted into the pocket 40 in combination with the secondary insert 60. As shown in FIG. 17, the cap 50 may be a plug that is affixed to the secondary insert 60 and disposed within the pocket 40 so that the pocket 40 is entirely filled, or, as shown in FIG. 18, the cap 50 and secondary insert 60 combination may only partially fill the pocket 40, leaving some extra space empty within the pocket 40. As shown in FIG. 19, in these embodiments, the cap 50 effectively is an insert 70 having multiple materials 72, 74 that may have different densities, ranging from 1.47 g/cc to 17 g/cc. In all embodiments disclosed herein, the cap's 50 or insert's 70 configuration of materials and geometry can be varied within the optimal pocket 40 for a specific iron's loft to fine-tune the characteristics of the iron or create a progression of center of gravity and moment of inertia through a set of the irons, as well as to control sound and feel characteristics of the set.

Figure 20:
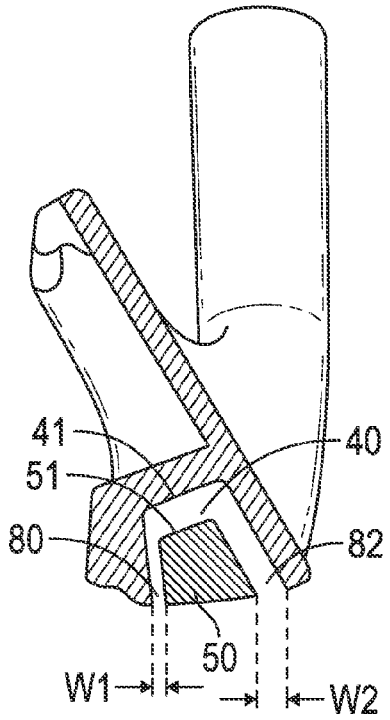
FIG. 20 is a cross-sectional view of a fourteenth embodiment of the present invention.
Figure 21:
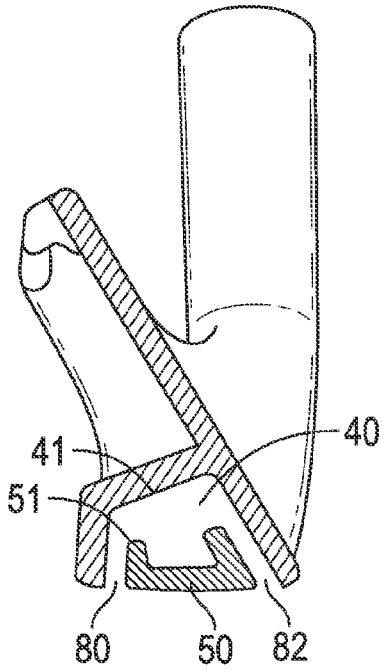
FIG. 21 is a cross-sectional view of a fifteenth embodiment of the present invention.
Figure 22:
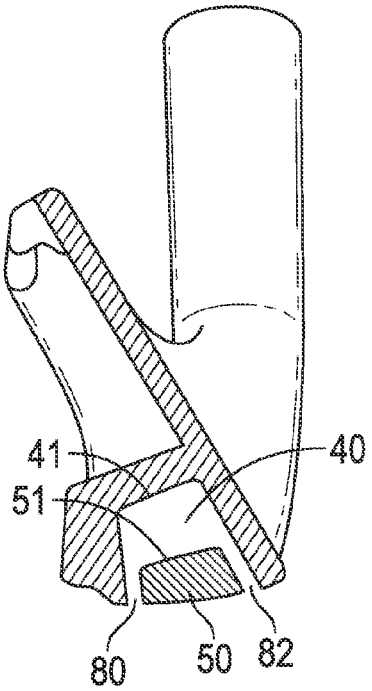
FIG. 22 is a cross-sectional view of a sixteenth embodiment of the present invention.

The location of the cap 50 within the pocket 40 can also be fine-tuned to adjust properties of the face and head, including feel, sound, backspin, and launch angle along and across the face, as well as face compliance and ball speed. For example, the cap 50 may not be sized to fit snugly within the pocket 40. Instead, as shown in FIGS. 20-22, gaps 80, 82 may be disposed between one or more of the walls of the cap 50 and the walls of the pocket. As shown in FIGS. 21-22 and 24, the gaps 80, 82 may be of equal width or, as shown in FIGS. 20, 23, and 25, the gaps 80, 82 may have different widths W1, W2. The gaps 80, 82 can be partially or completely filled with welding, soldering, or brazing material, or with an adhesive material, to affix the cap 50 within the pocket 40, or may be left empty if the cap 50 is mechanically fastened within the pocket through a different surface, or is affixed within the pocket 40 by connecting an upper portion 51 of the cap 50 directly to an innermost surface 41 of the pocket 40. Because the gaps 80, 82 provide access to the interior of the pocket 40, they can be filled with a vibration dampening material to prevent debris from entering into the pocket 40 and to adjust the sound and feel of the golf club head 10 during use. Gaps 80, 82 can also be included with the secondary and tertiary inserts 60, 62 included in pockets 40, 42, 44, 46 shown in other embodiments of the present invention disclosed herein.

Figure 26:
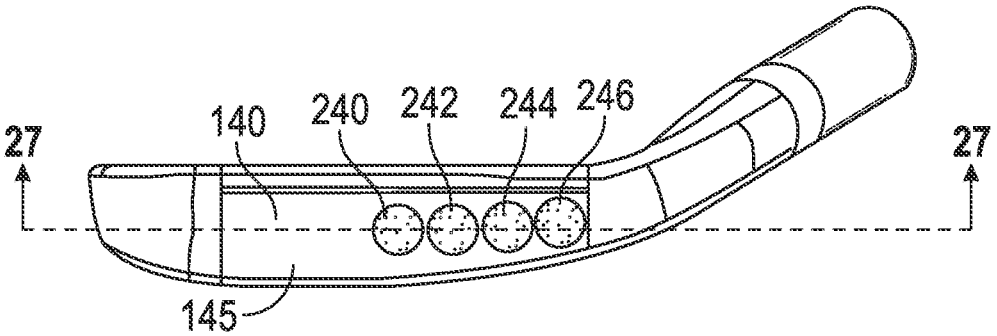
FIG. 26 is a sole perspective view of a twentieth embodiment of the present invention.
Figure 27:
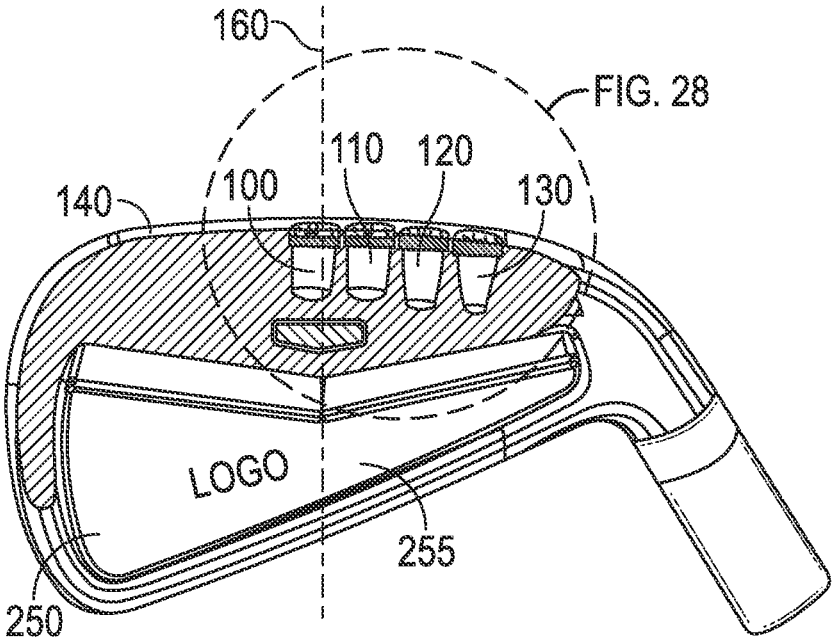
FIG. 27 is a cross-sectional view of the embodiment shown in FIG. 26 along lines 27-27.
Figure 28:
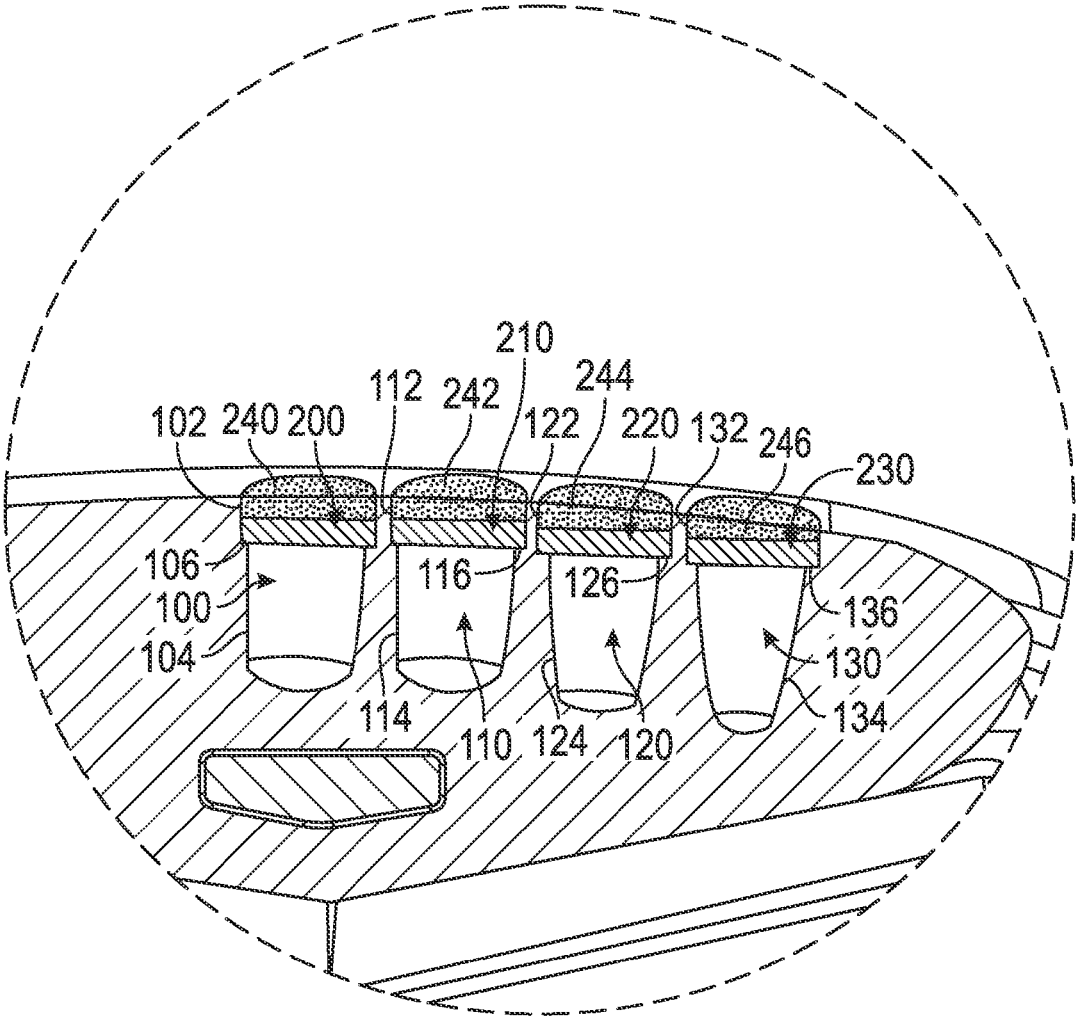
FIG. 28 is a close up view of the circled portion of the embodiment shown in FIG. 27.

The preferred embodiment of the present invention, shown in FIGS. 26-28, incorporates several of the features described in the other embodiments. In particular, the sole portion 140 of the golf club head 10 includes four, approximately cylindrical, recesses 100, 110, 120, 130 that extend into the sole in a direction approximately perpendicular to the surface 145 of the sole portion 140. Each recess 100, 110, 120, 130 preferably is disposed between the heel 16 of the club head 10 and a centerline 160 extending through a midpoint of the club head 10, and includes a first bore 102, 112, 122, 132, a second bore 104, 114, 124, 134, and a shelf 106, 116, 126, 136 disposed between the first bore 102, 112, 122, 132 and the second bore 104, 114, 124, 134. Each first bore 102, 112, 122, 132 has a diameter that is greater than the diameter of the corresponding second bore 104, 114, 124, 134, and is sized to receive one of four weight discs 200, 210, 220, 230, each of which rests against the shelf 106, 116, 126, 136 of the corresponding recess 100, 110, 120, 130. Each weight disc 200, 210, 220, 230 is composed of a tungsten material, but in other embodiments they may be made from any material having a density of no less than 14 g/cc and no more than 18 g/cc.

Once the weight discs 200, 210, 220, 230 are disposed within the first bore 102, 112, 122, 132 such that they rest against the respective shelves 106, 116, 126, 136, the weight discs 200, 210, 220, 230 are spot welded within the first bores 102, 112, 122, 132. The welding material 240, 242, 244, 246 fills the remaining area of the first bore 102, 112, 122, 132, thus covering each recess 100, 110, 120, 130 and making the sole surface 145 smooth and consistent across the entirety of the sole portion 140. As shown in FIGS. 27 and 28, in the preferred embodiment, the second bore 104, 114, 124, 134 is left empty (does not include any filler) in order to beneficially affect the sound and feel of the head during use. The sound and feel of the club head may also be adjusted by including a polymeric medallion 255 in a rear cavity 250 of the head.

The embodiments disclosed herein may be combined in any number of ways to create many different iron club head structures. For each of the embodiments disclosed herein, the cap 50 may be removably attached within the pocket, and may include surface features that affect interaction between the sole portion 14 and the turf during play, such that a user can switch caps 50 to adjust the turf interaction of a selected golf club. The embodiments disclosed herein may also include discontinuously attached face plates 25, such that the face plate is only attached to the body 15 of the club head 10 at specific points.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body comprising a top portion, a sole portion, and a face component, the sole portion defining a first recess with a first bore having a second diameter, a second bore having a third diameter, and a shelf located between the first bore and the second bore; and a weight disc having a first diameter, the first diameter smaller than the second diameter and greater than the third diameter, the weight disc removably secured within the first bore and resting against the shelf, wherein the weight disc is composed of a material having a density ranging from 14 g/cc to 18 g/cc, wherein the body is composed of a material having a density of no less than 5 g/cc and no greater than 9 g/cc, and wherein the second bore is empty.

2. The iron-type golf club head of claim 1, wherein the face component is selected from the group consisting of a face plate and a face insert.

3. The iron-type golf club head of claim 1, wherein the sole portion comprises a second recess, a third recess, and a fourth recess, and wherein each of the second, third, and fourth recesses comprises a first bore, a second bore, and a shelf.

4. The iron-type golf club head of claim 3, wherein the iron-type golf club head comprises a toe side, a heel side, and a center line, and wherein at least three of the first, second, third, and fourth recesses are disposed between the center line and the heel side.

5. The iron-type golf club head of claim 3, wherein the first recess has a first depth, the second recess has a second depth, the third recess has a third depth, and the fourth recess has a fourth depth, and wherein each of the first, second, third, and fourth depth differs from each of the other depths.

6. The iron-type golf club head of claim 3, wherein the first and second recesses each have a first depth, wherein the third and fourth recesses each have a second depth, and wherein the first depth is less than the second depth.

7. The iron-type golf club head of claim 3, wherein the at least one weight disc comprises a plurality of weight discs, each of which is sized to fit within the first bore of the first, second, third, and fourth recesses.

8. The iron-type golf club head of claim 3, wherein each of the plurality of weight discs has a mass of no less than 0.50 g and no more than 1.0 g.

9. The iron-type golf club head of claim 1, wherein the body is integrally formed using a method selected from the group consisting of casting, forming, and forging.

10. The iron-type golf club head of claim 1, wherein the at least one weight disc is composed of a tungsten alloy.

11. The iron-type golf club head of claim 1, further comprising a cap, wherein the cap is affixed within the first bore and presses the weight disc against the shelf.

12. An iron-type golf club head comprising:

a forged metal body comprising a top portion, a sole portion, and a face component, the sole portion defining a plurality of recesses, each of the plurality of recesses having a first bore having a second diameter, a second bore having a third diameter, and a shelf located between the first bore and the second bore;

a plurality of weight discs, each of the plurality of weight discs composed of a material having a density ranging from 14 g/cc to 18 g/cc, each of the plurality of weight discs having a first diameter, the first diameter smaller than the second diameter and greater than the third diameter, the weight disc positioned within the first bore and resting against the shelf of a corresponding recess of the plurality of recesses;

a welding material covering each of the plurality of weight discs.

13. The iron-type golf club head of claim 12, further comprising a medallion, wherein the body comprises a rear cavity, and wherein the medallion is permanently affixed within the rear cavity.

14. The iron-type golf club head of claim 12, wherein the plurality of tungsten alloy weight discs is composed of four tungsten alloy weight discs, and wherein the plurality of recesses is composed of four recesses.

* * * * *